United States Patent [19]

Komiyama et al.

[11] 4,091,245

[45] May 23, 1978

[54] DISTRIBUTOR ELECTRODE ASSEMBLY HAVING OUTER RESISTIVE LAYER FOR SUPPRESSING NOISE

[75] Inventors: Yoshiro Komiyama, Okazaki; Katsumi Kondo, Toyota; Yoichiro Asano, Toyota; Mituo Ando, Toyota, all of Japan

[73] Assignee: Toyota Jidosha Kogyo Kabushiki Kaisha, Japan

[21] Appl. No.: 702,938

[22] Filed: Jul. 6, 1976

Related U.S. Application Data

[62] Division of Ser. No. 588,051, Jun. 18, 1975, Pat. No. 3,992,230.

[30] Foreign Application Priority Data

Jun. 26, 1974 Japan ..... 49-72274
Feb. 3, 1975 Japan ..... 50-13472

[51] Int. Cl.[2] ..... H01H 19/00; H01H 1/00

[52] U.S. Cl. ..... 200/19 R; 123/146.5 A; 200/19 DC; 200/19 DR; 200/268

[58] Field of Search ..... 200/19 R, 19 DR, 19 DC, 200/262, 266, 267, 268, 269; 123/146.5 A; 252/513; 75/144, 170

[56] References Cited

U.S. PATENT DOCUMENTS

| | | | |
|---|---|---|---|
| 1,931,625 | 10/1933 | Schwarze | 315/58 |
| 1,997,460 | 4/1935 | Fitzsimmons | 315/291 |
| 2,294,482 | 9/1942 | Siegmund | 200/268 |
| 2,464,533 | 3/1949 | Shearer | 200/19 DC X |
| 2,555,488 | 6/1951 | Hetzler et al. | 315/58 |
| 3,209,298 | 9/1965 | Evanicsko, Jr. | 338/99 |
| 3,542,006 | 11/1970 | Dusenberry et al. | 123/146.5 A |
| 3,609,257 | 9/1971 | Jinsenji | 200/11 D |
| 3,949,721 | 4/1976 | Hori et al. | 200/19 R X |
| 4,007,342 | 2/1977 | Makino et al. | 200/19 R |
| 4,039,787 | 8/1977 | Hori et al. | 200/19 DR X |

FOREIGN PATENT DOCUMENTS 892,530 10/1953 Germany.

OTHER PUBLICATIONS

Most, C. R.; "Surface Coatings Available to Industry Today;" Soc. of Automotive Engineers, Inc.; May, 1969, 12 pp.

Sylvester, George R., "Coating with Plasmas;" Automation, Jul. 1970, pp. 76–79.

Longo, Frank N.; "Now Flame Spray Away Wear Problems as Never Before;" Materials Engineering, Jan. 1973, pp. 46–48.

*Primary Examiner*—James R. Scott

*Attorney, Agent, or Firm*—Stevens, Davis, Miller & Mosher

[57] ABSTRACT

A distributor for the ignition system of an internal combustion engine wherein the rotor and/or stationary terminals of the distributor are a brass or steel substrate bearing an intermediate layer of nickel aluminide and a further layer of electrically high resistive material, the resultant distributor exhibiting significantly suppressed noise emission.

2 Claims, 16 Drawing Figures

Fig. 1
Prior Art
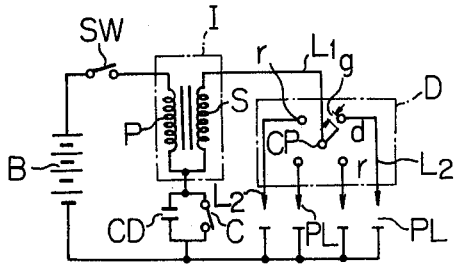
Fig. 2-a
Prior Art
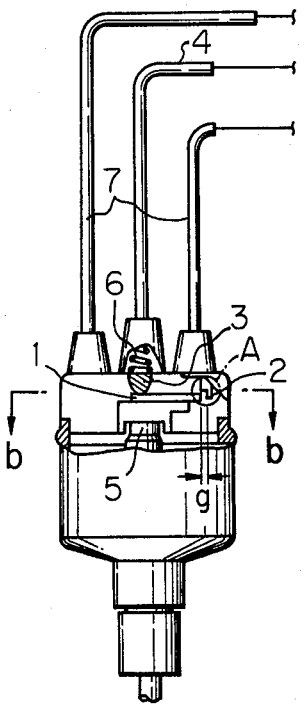
Fig. 2-b
Prior Art
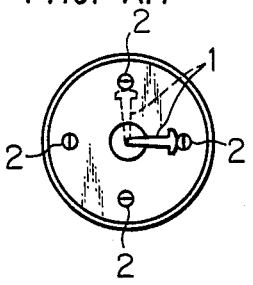

Fig. 3-a
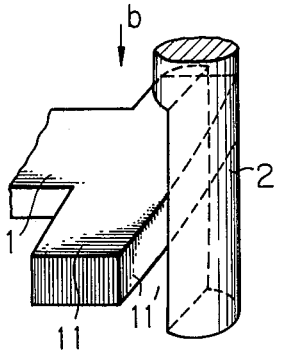
Fig. 3-b
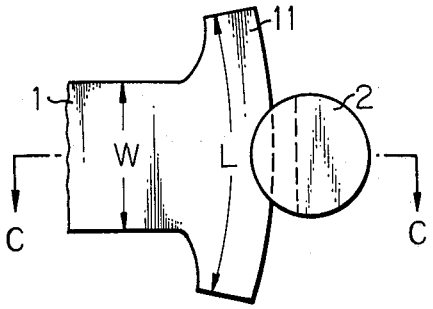
Fig. 3-c
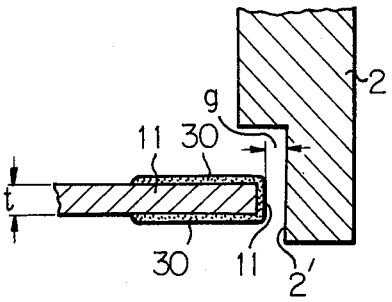
Fig. 4-c
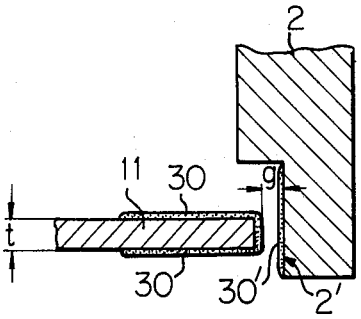

Fig. 12
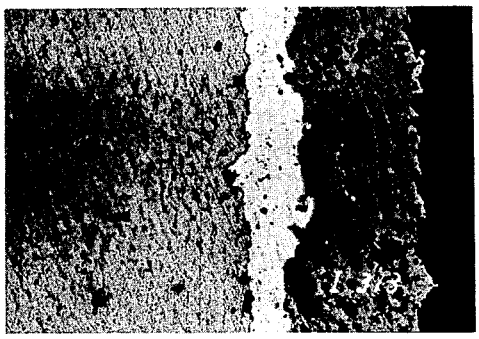
Fig. 11-a
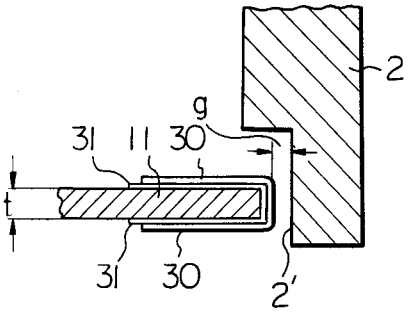
Fig. 11-b
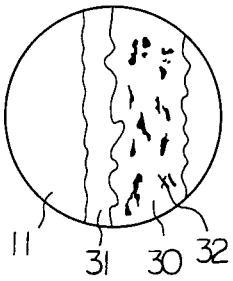

DISTRIBUTOR ELECTRODE ASSEMBLY HAVING OUTER RESISTIVE LAYER FOR SUPPRESSING NOISE

CROSS-REFERENCE TO RELATED APPLICATION

This is a Division of application Ser. No. 588,051 filed June 18, 1975, now U.S. Pat. No. 3,992,230.

BACKGROUND

The invention relates to methods for surface treatment of at least one electrode of both the distributor rotor and the stationary terminals in a distributor of an internal combustion engine for noise suppression. More particulary, it relates to methods for forming a layer of an electrically high resistive material onto a surface of at least one electrode of both the distributor rotor and the stationary terminals in a distributor of an internal combustion engine. The invention also relates to an improved distributor suitable for use in the ignition system of an internal combustion engine, which distributor emits significantly suppressed or reduced noise during the operation of the engine including said distributor.

Additional background information and explanation of the methods by which such improved distributors are made can be found in U.S. Pat. No. 3,992,230, the entire disclosure of which is hereby incorporated by reference in this application.

BRIEF SUMMARY OF THE INVENTION

In accordance with a special aspect of the invention, there is provided a distributor for the ignition system of an internal combustion engine with suppressed noise emission, which comprises a rotor and a plurality of stationary terminals operably arranged around and in close proximity to a circular locus defined by the rotation of said rotor, said rotor, when it rotates, being capable of successively forming a suitable gap for spark discharge between its electrode and an electrode of each of said stationary terminals, characterized in that either or both of said electrode of the rotor and said electrode of each terminal comprise a substrate made of brass or steel, an intermediate layer made of nickel aluminide comprising to 80 to 97% by weight of Ni and 20 to 3% by weight of Al, and an electrically high resistive layer primarily composed of CuO or NiO. The electrically high resistive layer should preferably have a thickness of 0.1 to 0.6 mm and an electrical resistance of $10^{-3}$ to $10^{9}$ Ω cm, preferably $10^{-1}$ to $10^{5}$ Ω cm.

BRIEF DESCRIPTION OF THE DRAWINGS

The present invention will be more apparent from the ensuing description with reference to the accompanying drawings wherein;

FIG. 1 is a typical conventional wiring circuit diagram of an igniter;

FIG. 2-*a* is a side view, partially cut off, showing a typical distributor utilized in the present invention;

FIG. 2-*b* is a sectional view taken along the line *b—b* of FIG. 2-*a;*

FIG. 3-*a* is a perspective view of electrodes for spark discharge utilized in the present invention;

FIG. 3-*b* is a plan view seen from the arrow *b* of FIG. 3-*a;*

FIG. 3-*c* is a sectional view taken along the line *c—c* of FIG. 3-*b;*

FIG. 4-*c* is a sectional view taken along the line *c—c* of FIG. 3-*b* in accordance with a modified embodiment of the electrodes for spark discharge;

FIG. 11-*a* is similar to FIG. 3*c* and illustrates the three layer contact base.

FIG. 11-*b* is a partially schematic enlargement of the three layers per se.

FIG. 12 is a photomicrograph showing the actual physical appearance of an exemplary three layer contact base.

DETAILED DESCRIPTION

Figure 5:
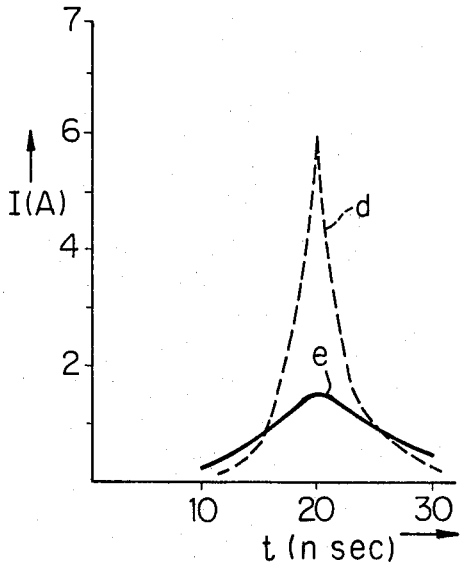
FIG. 5 is a graph showing changes of the current flow (in A), which is the so-called capacity discharge current in the igniter with an electrically high resistive material layer and an igniter without said layer with respect to time (in ns)

FIG. 1 is a typical conventional wiring circuit diagram of the igniter, the construction of which depends on the well known battery-type ignition system, as explained in more detail in U.S. Pat. No. 3,992,230.

It is a well known phenomenon that noise is radiated with the occurrence of a spark discharge. As can be seen in FIG. 1, three kinds of spark discharge occur at three portions in the igniter, respectively. A first spark discharge occurs at the contact point C of the contact breaker. A second spark discharge occurs at the small gap *g* between the electrode of the rotor *d* and the electrode of the terminal *r*. And a third spark discharge occurs at the spark plug PL. In various kinds of experiments, the inventors discovered that, among the three kinds of spark discharges, although the first and third spark discharges can ordinarily be suppressed by the capacitor and resistive spark plug respectively, the second spark discharge, which occurs at the small gap *g* between the electrode of the rotor *d* and the electrode of the terminal *r*, still radiates the strongest noise compared with the other two. This is because the second spark discharge includes a spark discharge, the pulse width of which is extremely small and the discharge current of which is extremely large. This spark discharge radiates the strongest noise from the high tension cables $L_1$ and $L_2$, which act as antennae.

Although the reason for the production of a spark discharge having an extremely small pulse width and an extremely large discharge current has already been explained in detail in U.S. Pat. No. 3,949,721.

A brief summary of said reason will be offered here. In FIG. 1, the high voltage of the induced high voltage surge from the secondary winding S appears at the rotor *d* not as a step-like wave, but as a wave in which a voltage at the rotor *d* increases and reaches said high voltage gradually with a time constant the value of which is mainly decided by the circuit constant of the ignition coil I and the primary high tension cable $L_1$. When the voltage which appears at the rotor *d* increases and reaches a sufficient voltage, it causes a spark discharge at the gap *g* between the electrodes of the rotor *d* and the terminal *r*, and, at the same time, the electric charge which has been charged to a distributed capacity along the primary high tension cable $L_1$, moves to a distributed capacity along the secondary high tension cable $L_2$ through the present spark discharge, which is generally called a capacity discharge. A voltage level along the primary high tension cable $L_1$ momentarily decreases when the capacity discharge occurs. However, immediately after said capacity discharge occurs, a voltage at the spark plug PL gradually increases with a certain time constant, and when said voltage reaches an adequate level, the spark discharge occurs at the spark plug PL. This spark discharge is generally called an inductive discharge. Thereby, one ignition process is completed. Thus, a spark discharge current which flows through the small gap *g*, is produced in accordance with the capacitive discharge and the inductive discharge, respectively. Above all the strongest noise accompanied by deleterious high frequencies has been found in connection with the capacity discharge which includes a great deal of discharge pulses having an extremely small pulse width and an extremely large discharge current. Therefore, the principles of the present invention are to transform said wave of the capacity discharge current into a wave with a relatively large pulse width and a relatively small discharge current. Therefore, the deleterious high frequency components are considerably lessened because of the stabilized capacity discharge current of the latter by the above-mentioned transformation of the wave. The construction of the electrodes including the electrically high resistive material layer which realizes the transformation of the wave of the capacity discharge current, will now be explained.

In FIGS. 2-*a* and 2-*b*, 1 indicates a distributor rotor (corresponding to *d* in FIG. 1), and 2 indicates a stationary terminal (corresponding to *r* in FIG. 1). The electrode of rotor 1 and the electrode of terminal 2 face each other with said small gap *g* (FIG. 2-*a* ) between them.

A center piece 3 (corresponding to CP in FIG. 1) touches the inside end portion of the rotor 1. The induced high voltage surge at the secondary winding S (FIG. 1) travels through a primary high tension cable 4 (corresponding to $L_1$ in FIG. 1) and through the center piece 3 to the electrode of the rotor 1. A spring 6 pushes the center piece 3 downward to the rotor 1, thereby making a tight electrical connection between them. At the time when the electrode of the rotor 1, which is indicated by the solid line in FIG. 3-*b*, faces the terminal 2, the high voltage surge is fed to the terminal 2 through a spark discharge and is applied to the corresponding spark plug PL (FIG. 1) through a secondary high tension cable 7 (corresponding to $L_2$ in FIG. 1), where the fuel air mixture is ignited in the corresponding cylinder. When the rotor 1 rotates to the position indicated by the dotted line in FIG. 3-*b*, and the electrode of the rotor 1 faces the next terminal 2, the high voltage surge is fed to the next terminal 2 through a spark discharge and is applied to the next corresponding spark plug PL (FIG. 1) through the other secondary high tension cable 7. In a similar way, the high voltage surge is sequentially distributed.

FIGS. 3-*a*, 3-*b* and 3-*c* show enlarged views of electrodes of the distributor rotor and the stationary terminal used in the present invention, which correspond to the members contained in circle A which is indicated by the chain dotted line in FIG. 2-*a*. In FIG. 3-*a* 11 indicates the electrode which is formed as a part of rotor 1 as one body and is T-shaped. A front surface 11′ of the electrode 11 faces a side surface 2′ (FIG. 3-*c*) of the terminal 2 with a spark discharging gap *g*. Both the front surface 11′ and the side surface 2′ act as electrodes for spark discharge. The width of the rotor 1 (indicated by W in FIG. 3-*b*) is about 5 (mm), and the length of the electrode 11 (indicated by L in FIG. 3-*b*) and the thickness of the electrode 11 (indicated by *t* in FIG. 3-*c*) are, respectively, about 10 (mm) and 1.0 (mm). The reference numeral 30 (FIG. 3-*c*) indicates the electrically high resistive material layer which is formed on the electrode by the method according to the present invention described in detail later. It should be noted that an electrically high resistive material layer can also be formed on the electrode 2′ as shown by the numeral 30′ in FIG. 4-*c*.

Accordingly, it is also possible to form electrically high resistive material layers on the electrode 11 and/or the electrode 2′.

FIG. 5 is a graph clarifying the effect of the electrically high resistive material layer on reducing the capacity discharged current. In FIG. 5 the wave form indicated by the solid line *e* and the one indicated by the dotted line *d* show the changes of the capacity discharge current when using and when not using the electrically high resistive material layer, respectively.

Like FIG. 3-*c*, FIG. 11-*a* shows an enlarged cross sectional view of electrodes of the distributor rotor and stationary terminal 2 used in the present invention. FIG. 11-*a* more clearly illustrates the three layer contact base comprising electrode base 11, intermediate layer 31, and outer electrically high resistive layer 30. FIG. 11-*b* shows a schematic enlargement of the three layers 11, 31, 30 of FIG. 11-*a*. FIG. 12 is a photomicrograph showing the actual appearance of an exemplary three layer contact base. See Examples 13–15, below herein, concerning this structure. In FIG. 5, the coordinates indicate a capacity discharge current I in A, and time in ns. It should be apparent from FIG. 5 that the maximum capacity discharge current I is remarkably reduced and at the same time, both the pulse width and the rise time of the capacity discharge current are expanded by forming the electrically high resistive material layer on the electrodes 11 and/or 2′. A capacity discharge current which includes deleterious high frequency components and thus radiates strong noise, can be transformed into a capacity discharge current which has almost no deleterious high frequency components, and only slight noise, by applying said electrically high resistive material layer to the electrode.

The reason the above-mentioned transformation of the capacity discharge current wave form can be accomplished is not known, but it is possible that a normal discharge at the spark discharging gap *g* between the electrodes 11 and 2′ does not occur because of the intervention of the electrically high resistive material layer 30 (30') which lies therebetween, thus interrupting the flow of the discharge current.

As mentioned above, both the rise time and the pulse width of the capacity discharge current are expanded by providing only the electrically high resistive material layer between the spark discharging gap *g*, whereby the deleterious high frequency components and the accompanying strong noise can be both eliminated from the capacity discharge current.

The following examples of the present invention show various kinds of methods which can be used to form the electrically high resistive material layer on the electrode.

It should be noted that each of the following examples by which said electrically high resistive material layer is formed on the surface of the electrode 11, is basically classified into one of three methods which are: firstly, applying finely divided particles having high electric resistance onto the surface of the electrode; secondly, applying onto the surface of the electrode finely divided particles the surface layers of which are capable of possessing high electric resistance when the surface layers are oxidized, and then, oxidizing the finely divided particles so applied onto said surface of the electrode; and thirdly oxidizing finely divided particles the surface layers of which are capable of possessing high electric resistance when the surface layers are oxidized, and applying said finely divided particles so oxidized onto the surface of the electrode. In each of the following examples, the electrically high resistive material layer is formed on only the surface of the electrode 11 in order to simplify the explanation.

EXAMPLE 1

Figure 6:
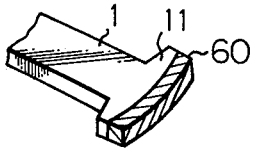
FIG. 6 is a perspective view of an electrode of the distributor rotor and shows the entire tip area on which an electrically high resistive material layer has been formed.

An electrode 11 made of brass (as shown in FIGS. 3-*a*, 3-*b* and 3-*c*) was washed with Triclene, duPont's trademarked trichloroethylene, and the area of the electrode (the hatched area 60 as shown in FIG. 6) to which a layer of electrically high resistive material was to be applied, was uniformly made coarse by a blasting technique. Using a METCO 3 MBT plasma gun (a trade name), a copper coating of 0.1 to 0.25 (mm) in thickness was applied to said area 60 by a plasma arc coating technique wherein finely divided copper of a size of −250 +350 mesh was sprayed onto said area 60 and was subjected to a plasma arc of an appropriate current, preferably 400 (amp.), while air cooling the surface of the electrode 11 at a temperature of not higher than 150° C. The electrode so-coated with copper was baked in a furnace at a temperature of 600° C for 2 hours and allowed to slowly cool whereby the copper layer was oxidized and an electrically high resistive material layer was obtained.

The distributor, in accordance with this example, was included in a conventional vehicle and was tested for the noise-field intensity level. The observed frequency of noise was within the range of from 50 to 300 (MHz). The observed level was 15 to 20 dB below the permitted value (ECE Reg 10). Further, the peak of the capacity discharge current (as designated by "*e*" in FIG. 5) of the distributor was revealed to be as low as 1.88 amp.

EXAMPLE 2

An electrode 11 made of brass (as shown in FIGS. 3-*a*, 3-*b* and 3-*c*) was washed with triclene, and the area of the electrode (the hatched area 60 as shown in FIG. 6) to which a layer of electrically high resistive material was to be applied, was uniformly made coarse by a blasting technique. Using a METCO 3 MBT gun (a trade name), an aluminum coating of 0.15 to 0.20 (mm) in thickness was applied to said area 60 by a plasma arc coating technique wherein finely divided aluminum of a size of −100 +250 mesh was sprayed onto said area 60 and was subjected to a plasma arc of an appropriate current, preferably 400 (amp.), while cooling the surface of the electrode 11 with air. The electrode so coated with aluminum was baked in a furnace at a temperature of 600° C for 2 hours and allowed to slowly cool whereby the aluminum layer was oxidized to a layer of electrically high resistive material.

The distributor, in accordance with this example, was included in a conventional vehicle and was tested for the noise-field intensity level in which the observed frequency of noise was within the range of from 50 to 300 (MHz). The observed level was 10 to 15 dB below the permitted value. Further, the peak of the capacity discharge current of the distributor was revealed to be as low as 1.67 amp.

EXAMPLE 3

An electrode 11 made of brass (as shown in FIGS. 3-*a*, 3-*b* and 3-*c*) was washed with triclene, and the area of the electrode (the hatched area 60 as shown in FIG. 6) to which a layer of electrically high resistive material was to be applied, was uniformly made coarse by a blasting technique. An aluminum oxide coating of 0.1 to 0.20 mm in thickness was applied to said area 60 by a plasma arc coating technique.

The distributor, in accordance with this example, was included in a conventional vehicle and was tested for the noise-field intensity level. Results similar to those as in Example 1 were obtained.

The above procedure was repeated except that the aluminum oxide was applied on the electrode by a thermo-spraying technique. Similar results were obtained.

EXAMPLE 4

An electrode 11 made of brass (as shown in FIGS. 3-*a*, 3-*b* and 3-*c*) was washed with triclene, and the area of the electrode (the hatched area 60 as shown in FIG. 6) to which a layer of electrically high resistive material was to be applied, was uniformly made coarse by a blasting technique. Using a mixture of 50% by weight of finely divided aluminum oxide and 50% by weight of finely divided aluminum, an electrically high resistive layer 30 of 0.25 (mm) in thickness was applied to the area 60 by a plasma arc coating technique.

The distributor, in accordance with this example, was included in a conventional vehicle and was tested for the noise-field intensity level in which an observed frequency of noise was within a range from 50 to 300(MHz). The level observed was 10 to 15 dB below the permitted value.

EXAMPLE 5

An electrode 11 made of brass (as shown in FIGS. 3-*a*, 3-*b* and 3-*c*) was washed with triclene, and the area of the electrode (the hatched area 60 as shown in FIG. 6) to which a layer of electrically high resistive material was to be applied was uniformly made coarse by a blasting techinque. Finely divided silicon of a size of −48 +100 mesh was applied onto said area 60 by a flame spraying technique, the so-called thermo-spray technique, using an oxygen-acetylene flame to form a coating of 0.15 to 0.20 (mm) in thickness.

The electrode so coated was baked in a furnace at an appropriate temperature and for an appropriate duration, preferably at 600° C and for 2 hours, and allowed to slowly cool whereby the silicon layer was oxidized and an electrically high resistive material layer was obtained.

The distributor, in accordance with this example, was included in a conventional vehicle and was tested for the noise-field intensity level in which the observed frequency of noise was within the range of from 50 to 300 (MHz). The level observed was 20 to 25 dB below the permitted value. Further, the peak of the capacity discharge current of the distributor was revealed to be as low as 1.0 amp.

EXAMPLE 6

Finely divided electrolytic copper of a size of −150 +350 mesh having an apparent density of 1.8 to 2.2 was oxidized to CuO by exposure to a hot air atmosphere in a furnace at a temperature of 600° C for 2 hours. The so obtained CuO was milled by vibration and screened to obtain a fraction of −100 +350 mesh.

An electrode 11 made of brass (as shown in FIGS. 3-*a*, 3-*b* and 3-*c*) was washed with triclene, and the area of the electrode (the hatched area 60 as shown in FIG. 6) to which a layer of electrically high resistive material was to be applied, was uniformly made coarse by a blasting technique. Onto said area 60, nickel aluminide (METCO No. 450) essentially consisting of 95.5% by weight of Ni and 4.5% by weight of Al was applied by a plasma arc coating technique to form a coating of 0.05 to 0.10 (mm) in thickness. The purpose of this coating is to enhance the adhesion of the electrically high resistive layer 30 to the electrode 11. Using a METCO 3 MBT gun (a trade name), a copper oxide coating of 0.1 to 0.15 (mm) in thickness was then applied to said area 60 by a plasma arc coating technique wherein the finely divided copper oxide was sprayed onto said area 60 and subjected to a plasma arc of 400 (amp) while cooling the surface of the electrode 11 with Air.

The distributor, in accordance with this example, was included in a conventional vehicle and was tested for the noise-field intensity level in which the observed frequency of noise was within the range of from 50 to 300 (MHz). The observed level was about 20 dB below the permitted value (ECE Reg 10). Further, the peak of the capacity discharge current of the distributor was revealed to be as low as 1.60 amp.

EXAMPLE 7

An electrode 11 made of brass (as shown in FIGS. 3-*a*, 3-*b* and 3-*c*) was washed with triclene, and the area of the electrode (the hatched area 60 as shown in FIG. 6) to which a layer of electrically high resistive material was to be applied, was uniformly made coarse by a blasting technique. Onto said area, 60 particulate nickel aluminide (METCO No. 450) essentially consisting of 95.5% by weight of Ni and 4.5% by weight of Al was applied by a plasma arc coating technique to form a coating of 0.05 to 0.10 (mm) in thickness. On the layer of nickel aluminide, finely divided copper of a size of −150 mesh was applied by a plasma arc coating technique to form a coating of 0.2 to 0.3 (mm) in thickness.

The electrode so coated was baked in a furnace at an appropriate temperature and for an appropriate duration, preferably at 600° C for 2 hours, and allowed to slowly cool whereby the copper layer was oxidized to a layer of electrically high resistive material.

The distributor, in accordance with this example, was included in a conventional vehicle and was tested for the noise-field intensity level in which the observed frequency of noise was within the range of from 50 to 300 (MHz). The observed level was 15 to 20 dB below the permitted value. Further, the peak of the capacity discharge current of the distributor was revealed to be as low as 1.2 to 1.5 amp.

EXAMPLE 8

Figure 7:
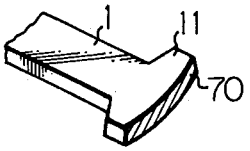
FIG. 7 is a perspective view of an electrode of the distributor rotor and shows one surface area on which an electrically high resistive material layer has been formed.

An electrode 11 made of brass (as shown in FIGS. 3-*a*, 3-*b* and 3-*c*) was washed with triclene, and the area of the electrode (the hatched area 70 as shown in FIG. 7) to which a layer of electrically high resistive material was to be applied was uniformly made coarse by a blasting technique. Onto said area 70, particulate nickel aluminide (METCO No. 450) essentially consisting of 95.5% by weight of Ni and 4.5% by weight of Al was coated by a plasma arc coating technique to form a coating of 0.05 to 0.10 (mm) in thickness. Finely divided electrolytic copper of a size of −150 +350 mesh having an apparent density of 1.8 to 2.0 was oxidized to cupric oxide by exposure to a hot air atmosphere in a furnace at a temperature of 800° C for 2 hours. The cupric oxide (CuO) was milled by vibration and screened to obtain a fraction of −100 +250 mesh. Onto said area 70 of the electrode having the coated layer of nickel aluminide, the finely divided cupric oxide (CuO) was applied by a plasma arc coating technique to form a coating of 0.2 to 0.3 (mm) in thickness. The electrode so coated was then exposed to a hot air atmosphere in a furnace at an appropriate temperature and for an appropriate duration, preferably at 400° C for 2 hours, to fully oxidize the surface of the coating.

The distributor, in accordance with this example, was included in a conventional vehicle and was tested for the noise-field intensity level in which the observed frequency of noise was within the range of from 50 to 300 (MHz). The observed level was about 20 to 25 dB below the permitted value. Further, the peak of the capacity discharge current of the distributor was revealed to be as low as 1.0 to 1.2 amp.

EXAMPLE 9

An electrode 11 made of brass (as shown in FIGS. 3-*a*, 3-*b* and 3-*c*) was washed with triclene, the area of the electrode (the hatched area 60 as shown in FIG. 6) to which a layer of electrically high resistive material was to be applied, was uniformly made coarse by a blasting technique. Onto said area 60, particulate nickel aluminide (METCO No. 450) essentially consisting of 95.5% by weight of Ni and 4.5% by weight of Al was applied by a plasma arc coating technique to form a coating 0.1 to 0.5 (mm) in thickness. The electrode so coated was baked in a furnace at an appropriate temperature and for an appropriate duration, preferably at a temperature of at 600° C for 2 hours, to oxidize the layer of nickel aluminide.

The distributor, in accordance with this example, was included in a conventional vehicle and was tested for the noise-field intensity level in which the observed frequency of noise was within the range of from 50 to 300 (MHz). The observed level was 15 to 20 dB below the permitted value. Further, the peak of the capacity discharge current of the distributor was revealed to be as low as 1.65 amp.

EXAMPLE 10

An electrode 11 made of steel (as shown in FIGS. 3-*a*, 3-*b* and 3-*c*) was washed with triclene, and the area of the electrode (the hatched area 90 as shown in FIG. 7) to which a layer of electrically high resistive material was to be applied, was uniformly made coarse by a blasting technique. Onto said area 70 particulate nickel aluminide essentially consisting of 95.5% by weight of Ni and 4.5% by weight of Al was applied by a plasma arc coating technique to form a coating of 0.05 to 0.10 (mm) in thickness. Finely divided electrolytic copper of a size of −150 +350 mesh having an apparent density of 1.8 to 2.0 was oxidized to cupric oxide by exposure to a hot air atmosphere in a furnace at an appropriate temperature and for an appropriate duration, preferably at 800° C for 2 hours. The cupric oxide was milled by vibration and screened to obtain a fraction of −100 +250 mesh. Onto said area 70 of the electrode having the layer of nickel aluminide coated thereon, the cupric oxide of a size of −100 +250 mesh was applied by a plasma arc coating technique with a thickness of 0.25 to 0.55 (mm).

The distributor, in accordance with this example, was included in a conventional vehicle and was tested for the noise-field intensity level and the peak of the capacity discharge current. The observed results were similar to or better than those obtained in Example 6 in which the same electrically high resistive layer 30 as in this example was applied to a brass electrode 11. The product of this example exhibited a better adhesion of the resistive layer to the electrode, than that of Example 6.

EXAMPLE 11

An electrode 11 made of steel (as shown in FIGS. 3-*a*, 3-*b* and 3-*c*) was washed with triclene, and the area of the electrode (the hatched area 70 as shown in FIG. 7) to which a layer of electrically high resistive material was to be applied, was uniformly made coarse by a blasting technique. Onto the area 70, particulate nickel aluminide essentially consisting of 95.5% by weight of Ni and 4.5% by weight of Al was applied by a plasma arc coating technique to form a coating of 0.05 to 0.10 mm in thickness. Onto said area 70 of the electrode having the layer of nickel aluminide coated thereon, finely divided nickel oxide was applied by a plasma arc coating technique with a thickness of 0.15 to 0.25 mm.

The distributor, in accordance with this example, was included in a conventional vehicle and was tested for the noise-field intensity level and the peak of the capacity discharge current. The observed results were approximately the same as those obtained in Example 6.

EXAMPLE 12

An electrode 11 made of steel (as shown in FIGS. 3-*a*, 3-*b* and 3-*c*) was washed with triclene, and the area of the electrode (the hatched area 70 as shown in FIG. 7) to which a layer of electrically high resistive material was to be applied, was uniformly made coarse by a blasting technique. Onto said area 70 particulate nickel aluminide essentially consisting of 95.5% by weight of Ni and 4.5% by weight of Al was applied by a plasma arc coating technique to form a coating of 0.05 to 0.10 (mm) in thickness. Finely divided electrolytic copper of a size of −150 mesh was oxidized to cupric oxide by exposure to a hot air atmosphere in a furnace at an appropriate temperature and for an appropriate duration, preferably at 800° C for 2 hours. The cupric oxide was milled and screened to obtain a fraction of −100 +250 mesh. Onto said area 70 of the electrode having the layer of nickel aluminide coated thereon, the cupric oxide was applied by a plasma arc coating technique with a thickness of 0.4 to 0.6 (mm).

The distributor, in accordance with this example, was included in a conventional vehicle and was tested for the noise-field intensity level and the peak of the capacity discharge current. The observed results were similar to or better than those obtained in Example 10 in which the thickness of the electrically high resistive layer 30 was somewhat different from that in this example. No undesirable exfoliation of the resistive layer 30 was observed even after repeated use of the product.

Influences, on the performance of the product, of the degree of oxidation and the thickness of the resistive layer and of the gap distance of the spark discharging gap g, were studied.

Figure 8:
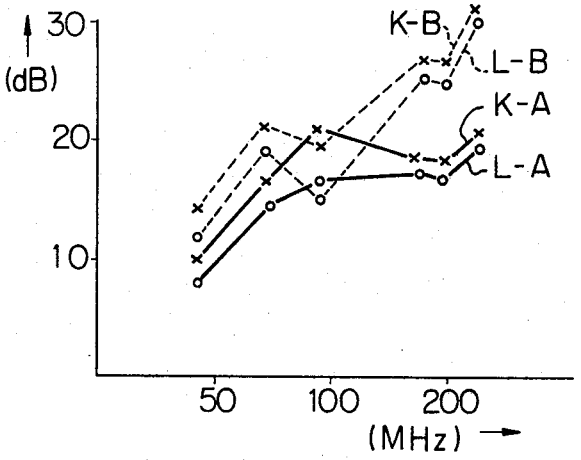
FIG. 8 is a graph showing changes of the noise-field intensity level of horizontal polarized waves with respect to an observed frequency (in MHz) by using electrodes according to example 12.

FIG. 8 illustrates the effects of the degree of oxidation of the resistive layer on the noise-field intensity level of the product, in which brass electrodes respectively plasma arc coated with two kinds of cupric oxide prepared by the oxidation of finely divided copper at the respective temperatures of 600° C for 2 hours, symbolized by "K", and 800° C for 2 hours, symbolized by "L", are compared. In FIG. 8, the abscissa indicates the frequency at which the noise-field intensity level is measured and the other coordinate indicates the noise-field intensity level of horizontal polarized waves in dB in which 0 (dB) corresponds to 1 (μv/m). The performances K-A and L-A were obtained by using one vehicle A and the performances K-B and L-B were obtained by using another vehicle B. As seen from FIG. 8, better results are obtainable when oxidation is 800° C.

Figure 9:
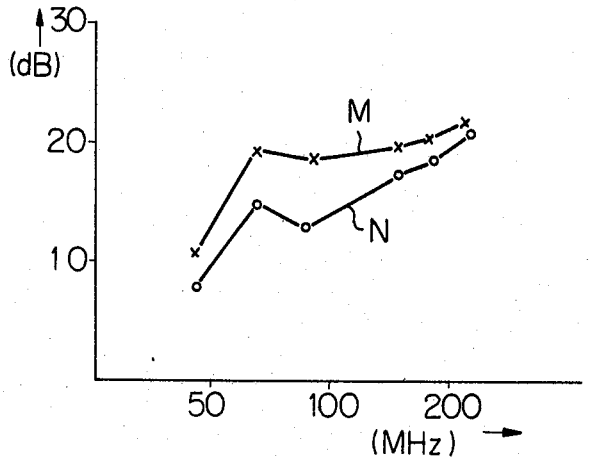
FIG. 9 is a graph showing changes of the noise-field intensity level of horizontal polarized waves with respect to an observed frequency (in MHz) by using electrodes according to example 9.

FIG. 9 illustrates the effects of the thickness of the resistive layer on the noise-field intensity level of the product, in which brass electrodes plasma are coated with cupric oxide prepared by the oxidation of finely divided copper at 800° C for 2 hours with respective thicknesses of 0.15 to 0.25 (mm) and 0.4 to 0.5 (mm), are compared. In FIG. 9, the abscissa indicates the frequency at which the noise-field intensity level is measured and the other coordinate indicates the noise-field intensity level of horizontal polarized waves in dB in which 0 (dB) corresponds to 1 (μv/m). The performance M was obtained by using a resistive layer the thickness of which was 0.15 to 0.25 (mm) and the performance N was obtained by using a resistive layer the thickness of which was 0.4 to 0.5 (mm). As seen from FIG. 9, better results are obtainable when the thickness is 0.4 to 0.5 mm. With thickness of 0.3 (mm) or more, little or no difference was observed in the noise-field intensity level of the products at a given frequency. Moreover, excessive thickness involves a longer period of time for coating and includes the serious problem of exfoliation or peeling off of the coating. For most cases, a thickness of 0.3 to 0.5 (mm) is preferable.

Figure 10:
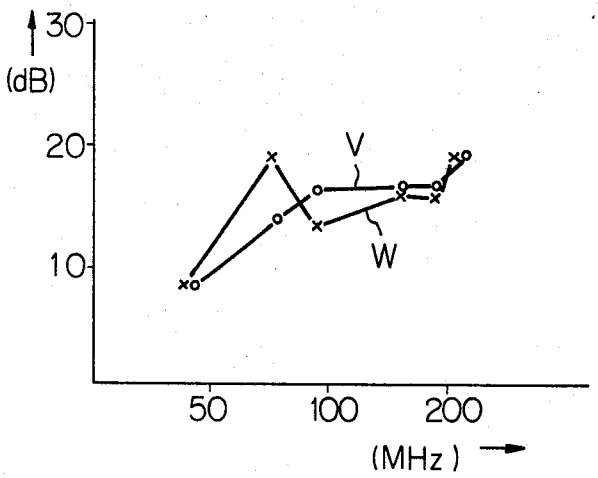
FIG. 10 is a graph showing changes of the noise-field intensity level of horizontal polarized waves with respect to an observed frequency (in MHz) by using electrodes according to example 10.

FIG. 10 illustrates the effects of a base material of the electrode on the noise-field intensity level of the product, in which brass and steel based electrodes having a resistive layer of cupric oxide plasma arc coated thereon are compared. In FIG. 9, the abscissa indicates the frequency at which the noise-field intensity level is measured and the other coordinate indicates the noise-field intensity level of horizontal polarized waves in dB in which 0 (dB) corresponds to 1 (μv/m). The performance V and W were respectively obtained by using a brass based electrode and a steel based electrode. FIG.

10 indicates that there is almost no difference in the noise-field intensity level between the brass and steel based electrodes.

While there is a slight difference in the noise-field intensity level between the products having a resistive layer coated on the respective areas as shown in FIGS. 6 and 7, for mass-production, coating the electrode with a resistive layer on the area as shown in FIG. 7, is preferable.

The capacity discharge current of the product was measured with varied gap distances of the spark discharging gag *g*. The tested electrode was prepared by coating a brass electrode with nickel aluminide, on the area shown in FIG. 7, to a thickness of 0.05 to 0.10 (mm) and applying thereon particulate CuO (obtained by the oxidation of particulate copper at a temperature of 800° C for 2 hours) to form a top coating of 0.30 to 0.50 (mm). See FIG. 11-*a*. The test for measuring the capacity discharge current was made by using one such electrode having a gap distance *g* of 0.35 to 0.40 (mm) and another such electrode having a gap distance *g* of 0.7 to 0.8 (mm). The result of the test was that the observed peak value of the capacity discharge current when using said electrodes having a gap distance *g* of 0.35 to 0.40 (mm), is lower than that of said electrodes having a gap distance *g* of 0.7 to 0.8 (mm) by 1/4 to 1/4.5 times.

EXAMPLE 13

An electrode 11 made of steel (as shown in FIGS. 3-*a*, 3-*b* and 3-*c*) was washed with triclene, and the area of the electrode (the hatched area 70 as shown in FIG. 7) to which a layer of electrically high resistive material was to be applied, was uniformly made coarse by a blasting technique. Onto said area 70 particulate nickel aluminide essentially consisting of 95.5% by weight of Ni and 4.5% by weight of Al was applied by a plasma arc coating technique to form a coating of 0.05 to 0.10 (mm) in thickness. Finely divided electrolytic copper of a size of −150 mesh was oxidized to cupric oxide by exposure to a hot air atmosphere in a furnace at a temperature of 800° C for 2 hours. The cupric oxide was milled and screened to obtain a fraction of −100 +250 mesh. Onto said area 70 of the electrode having the layer of nickel aluminide coated thereon, the cupric oxide was applied by a plasma arc coating technique with a thickness of 0.4 to 0.6 (mm). This structure is shown in FIG. 11-*a*.

The surface layer so formed proved to contain a substantial proportion of $Cu_2O$. The electrode was then baked in an air furnace at a temperature of 400° C for 5 hours to convert the $Cu_2O$ to CuO whereby an electrically high resistive material layer 30 substantially free of $Cu_2O$ was obtained.

The distributor, in accordance with this example, was included in a conventional vehicle and was tested for the peak of the capacity discharge current and the noise-field intensity level in which the observed frequency of noise was within the range of from 50 to 300 (MHz). The observed level was about 20 (dB) below the permitted value. Further, the peak of the capacity discharge current of the distributor was revealed to be as low as 1.6 amp. These results are similar to those obtained in Example 12. However, the performance of the distributor of this example was more stable than that of the distributor obtained in Example 12.

EXAMPLE 14

An electrode 11 made of brass (as shown in FIGS. 3-*a*, 3-*b* and 3-*c*) was washed with triclene, and the area of the electrode (the hatched area 70 as shown in FIG. 7) to which a layer of electrically high resistive material was to be applied, was uniformly made coarse by a blasting technique. Onto said area 70 particulate nickel aluminide essentially consisting of 95.5% by weight of Ni and 4.5% by weight of Al was applied by a plasma arc coating technique to form a coating of 0.05 to 0.10 (mm) in thickness. Finely divided cupric oxide of a size of −150 +250 mesh was applied onto said area 70 of the electrode having the layer of nickel aluminide coated thereon, with a thickness of 0.4 to 0.6 (mm), by a thermo-spraying process using an oxyacetylene flame. This structure is shown in FIG. 11-*a*.

The distributor, in accordance with this example, was included in a conventional vehicle and was tested for the peak of the capacity discharge current and the noise-field intensity level in which the observed frequency of noise was within the range of from 50 to 300 (MHz). The observed level was about 22 to 25 dB below the permitted value, and the peak of the capacity discharge current of the distributor was revealed to be as low as 1.0 to 1.2 amp. When compared with a distributor wherein the electrode has the electrically high resistive material layer applied thereto by a plasma arc coating process, a distributor wherein the electrode has the electrically high resistive material layer applied thereto by a thermo-spraying process, proved to be far more stable in performance. It is believed that this is because of the difference in proportions of $Cu_2O$ contained in the surface layers.

We have found that a surface layer, formed from particulate CuO by using a plasma arc coating process, comprises not only CuO but also $Cu_2O$ and Cu. Even under optimum conditions, the formed electrically high resistive layer contains at least 20% by weight of $Cu_2O$. The formation of such $Cu_2O$ is undesirable from the view point of a stable performance. The processes as described in Examples 13 and 14 are quite effective for reducing the formation of $Cu_2O$.

With respect to the composition of the surface layer formed from particulate CuO by using a plasma coating process, further studies using X-ray diffraction analysis revealed that while the top layer essentially consists of CuO, the under-lying layer located 100 microns or more from the surface contains $Cu_2O$ in considerable amounts, for example, 20 to 40% by weight or more. It is believed that when CuO is subjected to the action of a plasma arc it would at least partially be decomposed to $Cu_2O$. Most of the $Cu_2O$ would be oxidized by oxygen in the atmosphere to CuO before, during or after depositing on the electrode. However, when the process is continuously carried out the $Cu_2O$ deposited on the electrode would be covered by freshly sprayed $Cu_2O$ before the former has been oxidized by the air to CuO. Thus, it is considered that if the process is carried out intermittently so that the $Cu_2O$ deposited on the electrode by one shot coating may be sufficiently oxidized to CuO before the next shot coating, an electrically high resistive layer primarily composed of CuO would be obtained. The following example was carried out on the basis of the above considerations.

EXAMPLE 15

An electrode 11 made of steel (as shown in FIGS. 3-*a*, 3-*b* and 3-*c*) was washed with triclene, and the area of the electrode (the hatched area 70 as shown in FIG. 7) to which a layer of electrically high resistive material was to be applied, was uniformly made coarse by a blasting technique. Onto said area 70 particulate nickel aluminide essentially consisting of 95.5% by weight of Ni and 4.5% by weight of Al was applied by a plasma arc coating technique to form a coating of 0.05 to 0.10 (mm) in thickness. Finely divided electrolytic copper of a size of −150 mesh was oxidized to cupric oxide by exposure to a hot atmosphere in a furnace at an appropriate temperature and for an appropriate duration, preferably at 800° C for 2 hours. Onto said area 70 of the electrode having the layer of nickel aluminide coated thereon, the cupric oxide was applied by a plasma arc coating technique with a thickness of about 50 microns. The spraying operation was discontinued for about 20 seconds to permit the oxidation of the coated layer. The cycle consisting of the plasma arc coating of a 50 $\mu$ layer and the subsequent oxidation was repeated 10 times. This structure is shown in FIG. 11-*a*.

The distributor, in accordance with this example, was included in a conventional vehicle and was tested for the noise-field intensity level and the peak of the capacity discharge current. The observed results were similar to or better than those obtained in Example 13. However, the performance of the distributor of this example was far more stable than that of the distributor obtained in Example 13.

Thus, in accordance with a still further aspect of the invention, there is provided a method for surface treatment of at least one electrode of both the distributor rotor and the stationary terminals in a distributor of an internal combustion engine for noise suppression, wherein finely divided cupric oxide is applied onto said surface of the electrode by a plasma arc coating process until a surface layer having a thickness of 50 to 100 microns is formed, followed by subjecting the layer so-formed to oxidizing conditions, and such a cycle consisting of the plasma arc coating and the subsequent oxidation is repeated until the desired surface layer having a total thickness of 0.1 to 0.6 mm is formed. That method is further described in U.S. Pat. No. 3,992,230.

What I claim is:

1. A distributor for the ignition system of an internal combustion engine with suppressed noise emission, which comprises a rotor and a plurality of stationary terminals operably arranged around and in close proximity to a circular locus defined by the rotation of said rotor, said rotor, when it rotates, being capable of successively forming a suitable gap for spark discharge between its electrode and an electrode of each of said stationary terminals, characterized in that at least one of said electrode of the rotor and said electrode of each terminal comprise a substrate made of brass or steel, an intermediate layer made of nickel aluminide comprising 80 to 97% by weight of Ni and 20 to 3% by weight of Al, and an electrically high resistive layer primarily composed of CuO or NiO.

2. A distributor as set forth in claim 1 wherein said electrically high resistive layer has a thickness of 0.1 to 0.6 mm.

* * * * *